US010047690B2

(12) United States Patent
Eser et al.

(10) Patent No.: US 10,047,690 B2
(45) Date of Patent: Aug. 14, 2018

(54) SIGNAL DETECTION FOR BALANCING CYLINDERS IN A MOTOR VEHICLE

(71) Applicant: Continental Automotive GmbH, Hannover (DE)

(72) Inventors: Gerhard Eser, Hemau (DE); Dirk Heinitz, Undorf (DE); Wolfgang Moser, Regensburg (DE); Martin Reisinger, Hemau (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 9 days.

(21) Appl. No.: 14/916,047

(22) PCT Filed: Jul. 2, 2014

(86) PCT No.: PCT/EP2014/064050
§ 371 (c)(1),
(2) Date: Mar. 2, 2016

(87) PCT Pub. No.: WO2015/032521
PCT Pub. Date: Mar. 12, 2015

(65) Prior Publication Data

US 2016/0201585 A1 Jul. 14, 2016

(30) Foreign Application Priority Data

Sep. 5, 2013 (DE) ..... 10 2013 217 725

(51) Int. Cl.
*F02D 41/00* (2006.01)
*F02D 41/14* (2006.01)
*F02D 41/28* (2006.01)

(52) U.S. Cl.
CPC ..... *F02D 41/0085* (2013.01); *F02D 41/1498* (2013.01); *F02D 2041/288* (2013.01); *F02D 2200/1012* (2013.01)

(58) Field of Classification Search
CPC ..... F02D 41/0085; F02D 41/1498; F02D 2200/1012; F02D 2041/288; F02D 41/009; F02D 2200/1015
(Continued)

(56) References Cited

U.S. PATENT DOCUMENTS 5,709,192 A * 1/1998 Zimmermann ..... F02D 41/0087 123/436
6,021,758 A * 2/2000 Carey ..... F02D 41/0085 123/406.24
(Continued)

FOREIGN PATENT DOCUMENTS

DE 19545008 A1 6/1997 ..... B23Q 17/09
DE 19700711 A1 9/1998 ..... F02D 41/00
(Continued)

OTHER PUBLICATIONS

DE 102011111412 A1—English Translation.*
(Continued)

*Primary Examiner* — Joseph Dallo
*Assistant Examiner* — Scott A. Reinbold
(74) *Attorney, Agent, or Firm* — Slayden Grubert Beard PLLC

(57) ABSTRACT

The present disclosure teaches method for balancing cylinders in a motor vehicle including an engine which has at least two cylinders. The method may include: determining a cycle period of a cycle of the engine and a number of cycles of the engine, determining a cylinder value function for each cylinder of the engine for each cycle indicative of acceleration of a crankshaft of the engine caused by the corresponding cylinder, carrying out a signal analysis for each cylinder value function, detecting an amplitude for each signal, forming an amplitude mean value for each cylinder, detecting irregular running of the engine on the basis of the
(Continued)

amplitude mean values, and compensating for the detected irregular running of the engine.

18 Claims, 7 Drawing Sheets

(58) Field of Classification Search
USPC ..... 123/445
See application file for complete search history.

(56) References Cited

U.S. PATENT DOCUMENTS

| | | | | |
|---|---|---|---|---|
| 2009/0292440 | A1* | 11/2009 | Ichihara | F02D 41/0085 701/102 |
| 2011/0239984 | A1* | 10/2011 | Lee | F02D 41/0085 123/339.14 |
| 2013/0340512 | A1* | 12/2013 | Horlbeck | F02D 41/1497 73/114.02 |

FOREIGN PATENT DOCUMENTS

| | | | | |
|---|---|---|---|---|
| DE | 19720009 | C2 | 8/2000 | F02D 41/00 |
| DE | 102005047829 | B3 | 5/2007 | F02D 41/00 |
| DE | 102011111412 | A1 * | 2/2013 | F02D 41/0085 |
| EP | 0198137 | A2 | 10/1986 | F02D 45/00 |
| WO | 2009/121673 | A1 | 10/2009 | F02D 41/00 |
| WO | WO 2009121673 | A1 * | 10/2009 | F02D 41/0085 |
| WO | 2015/032521 | A1 | 3/2015 | F02D 41/00 |

OTHER PUBLICATIONS

WO 2009121673 A1—English Translation.*
Ostman, F. et al., "Model-Based Torsional Vibration Control of Internal Combustion Engines," IET Control Theory and Applications, vol. 2, No. 11, pp. 1024-1032 (9 pages), Jun. 11, 2008.
German Office Action, Application No. 102013217725.9, 5 pages, dated Mar. 24, 2014.
International Search Report and Written Opinion, Application No. PCT/EP2014/064050, 17 pages, dated Oct. 17, 2014.

* cited by examiner

SIGNAL DETECTION FOR BALANCING CYLINDERS IN A MOTOR VEHICLE

CROSS-REFERENCE TO RELATED APPLICATIONS

This application is a U.S. National Stage Application of International Application No. PCT/EP2014/064050 filed Jul. 2, 2014, which designates the United States of America, and claims priority to DE Application No. 10 2013 217 725.9 filed Sep. 5, 2013, the contents of which are hereby incorporated by reference in their entirety.

TECHNICAL FIELD

The disclosure relates to signal detection and, more specifically, teaches a method for balancing cylinders in an internal combustion engine of a motor vehicle.

BACKGROUND

In internal combustion engines, the injection masses can vary considerably between the individual cylinders owing to fabrication tolerances of the injection system and/or as a result of ageing. Any differences in the injection masses may lead to a torque difference between the cylinders which will have an adverse effect on the overall performance of the internal combustion engine. In addition, secondary assemblies may also give rise to torque fluctuations of other frequencies. These mechanically caused rotational irregularities cannot be eliminated by known cylinder balancing routines (CYBL) or closed loop combustion control routines (CLCC).

Patent DE 197 20 009 C2 discloses a method which calculates the rotational speed for the expansion and the rotational speed for the compression for each cylinder. The difference between the rotational speeds is filtered by means of a sliding mean value formation and a cylinder-selective deviation is formed on the basis of the respective rotational speed deviations. A fuel mass correction is calculated on the basis of this deviation.

Furthermore, DE 197 00 711 A1 is known. This document describes a method in which a correction value for the injection time is applied as a function of the irregular running.

DE 10 2005 047 829 B3 is known. Said document describes a method for compensating the harmonic components of the crankshaft rotational speed. In this context, a time period of at least one revolution of a camshaft or two revolutions of a crankshaft is considered. The rotational speed signal is considered here by means of a Fourier analysis.

A further possible way of separating off the effects is to use filters, such as, for example, a reject-pass filter. However, this severely degrades the signal quality.

SUMMARY OF THE INVENTION

The present disclosure teaches methods which may improve the regular running of an internal combustion engine.

According to some embodiments, a method for balancing cylinders of a motor vehicle is described, wherein the motor vehicle has an engine which has at least two cylinders. The method comprises: determining a cycle period of a cycle of the engine and a number of cycles of the engine, determining a cylinder value function for each cylinder of the engine for each cycle, wherein the cylinder value function is indicative of the acceleration of a crankshaft of the engine, which is caused by the corresponding cylinder. The method also comprises carrying out a signal analysis for each determined cylinder value function, detecting an amplitude for each signal analysis which is carried out, forming an amplitude mean value for each cylinder on the basis of the detected amplitudes of the respective cylinder, detecting irregular running of the engine, on the basis of the amplitude mean values which are formed, and compensating the detected irregular running of the engine.

A cycle period of a cycle of an engine according to the invention can be in this context, in particular, that time which is required until the engine or the crankshaft of the engine has carried out a corresponding number of 180° rotational passes, wherein a 180° rotational pass corresponds to half a revolution of the engine or of the crankshaft, and a 360° rotational pass can correspond to a full revolution of the engine or of the crankshaft. Two 360° engine rotational passes can correspond here in the case of a four-stroke engine to a working cycle of the engine, that is to say to two revolutions of the crankshaft.

A value function according to the invention, for example, a cylinder value function, can be a mathematical function obtained on the basis of detected values at various times. In the case of a cylinder value function this can be, for example, a sinusoidal function on the basis of detected acceleration values of the crankshaft of the engine at various times, which acceleration values can be caused by the corresponding cylinder.

Signal analysis may include a description of dynamic properties of an oscillation system on the basis of the input signals and/or output signals of said system.

Irregular running of the engine according to the invention can be here, as an example, irregular rotation of the crankshaft which can be caused, for example, by torque differences between the cylinders of the engine.

Compensating detected irregular running of the engine can be, in particular, a process which can compensate the detected degree of irregular running of the engine. This can be done, for example, by means of open-loop control and preferably by means of closed-loop control. This can be done on an engine-selective basis, for example by compensating the degree of irregular running of the engine individually at each cylinder. This can have the advantage that the irregular running of the engine can be free of rotational irregularities resulting from secondary assemblies of the motor vehicle, and therefore the original irregularity, caused by trimmed injection can be reconstructed and correspondingly compensated again. Secondary assemblies can be here, for example, the dynamo or else the air-conditioning system of a motor vehicle. In addition, this can have the advantage that increased regular running of the engine can be achieved.

In some embodiments, the determination of the cylinder value function for each cylinder of the engine for each cycle is carried out on the basis of an engine value function, wherein the engine value function is indicative of the acceleration of a crankshaft of the engine which is caused by all the cylinders.

This can have the advantage that engine irregularities in the form of, for example, torque irregularities can be adapted at the location at which they are transmitted to the rotational movement of the engine and therefore a more reliable value base can be provided.

In some embodiments, the engine value function is formed on the basis of the detection of values relating to an engine variable of the engine over a cycle time period.

In some embodiments, an engine variable can be a variable which is derived from the acceleration of the crankshaft of the engine such as, for example, an engine rotational speed, a tooth time, a rotational speed gradient, an engine acceleration, an engine roughness and the like.

This can have the advantage that measured values can be made available as a value basis and can usually already be detected in motor vehicles, allowing unnecessary expenditure to be avoided.

In some embodiments, the cycle time period corresponds to a total duration of the number of cycles.

A cycle time period can be the time period in which function values for forming the engine value function can be detected.

This can have the advantage that cyclical fluctuations such as can be caused, for example, by secondary assemblies, can become better visible and can therefore be eliminated better.

In some embodiments, the determination of the cylinder value function for each cylinder of the engine for each cycle is carried out on the basis of a corresponding subdivision of the engine value function.

The corresponding subdivision of the engine value function according to the invention can be, in particular, apportioning and assignment of the detected engine value function to the respective cylinder which corresponds to this part of the engine value function, that is to say causes it.

This can have the advantage that a uniquely defined cylinder-selective assignment of the variable which is to be examined and which is derived from the crankshaft can be made possible.

In some embodiments, the signal analysis has a frequency analysis, preferably the spectral analysis of a Fourier transformation, preferably a Fast Fourier transformation.

A frequency analysis according to the invention can be, in particular, investigation as to how frequently certain events occur in a certain time unit and, in particular, which frequency components are represented to which degree in a signal.

A spectral analysis according to the invention can be here, in particular, an image function which is acquired from a Fourier analysis.

This can have the advantage that an amplitude can be determined in a reliable way for each signal analysis of each cylinder value function.

In some embodiments, the cycle period is that time period which corresponds to a working cycle of the engine.

A cycle of an engine can correspond in the case of a four-stroke engine to a working cycle of the engine. In the case of a four-stroke engine, a working cycle can comprise two revolutions of the crankshaft and therefore of the engine. The individual strokes can comprise here induction, compression, expansion and expulsion. In the case of a two-stroke engine, one working cycle can occur per revolution of the crankshaft of the engine.

This can have the advantage that rotational irregularities at the crankshaft or at the engine can be detected completely at least once on a cylinder-selective basis for each cylinder and can therefore be compensated.

In some embodiments, the determination of the number of cycles is carried out on the basis of a prediction.

Determining the number of cycles on the basis of a prediction according to the invention can mean, in particular, that it can become possible to make a prediction on the basis of which it can be determined how many cycles can probably be necessary to determine the engine value function, preferably probable at minimum, in order to be able to determine the cycle time period on the basis thereof.

This can have the advantage that only a relatively small number of cycles may be necessary to balance the cylinders, as a result of which the balancing of the cylinders can be performed very quickly and therefore efficiently.

In some embodiments, the prediction is based on an expected interference frequency.

Secondary assemblies can cause, for example, additional torque oscillations of other frequencies in the crankshaft or in the engine, that is to say the introduction of possibly irregular injection masses into the respective cylinders of the engine.

As a result, mechanically caused rotational irregularities of different frequencies can come about. For secondary assemblies it is possible to determine possible interference frequencies, wherein the different interference frequencies can be predominant in different secondary assemblies. Predicting these interference frequencies as well as possible can contribute to performing the balancing of the cylinders in the best possible way and in the shortest possible time.

This can have the advantage that the balancing of the cylinders can be performed even better, more quickly and more efficiently.

In some embodiments, the compensation of the detected irregular running of the engine is carried out on the basis of an algorithm, preferably on the basis of a cylinder balancing algorithm, particularly preferably on the basis of a cylinder balancing via engine roughness algorithm and/or a closed loop combustion control algorithm.

This can have the advantage that the detected irregular running of the engine can be compensated by means of known and reliable algorithms, which can permit better cost efficiency.

In some embodiments, an engine control device for a vehicle may implement a method according to one or more of the above-mentioned embodiments is described.

BRIEF DESCRIPTION OF THE DRAWINGS

Further advantages and refinements of the present invention can be found in the following description of currently preferred embodiments. The individual figures in the drawing of this application are merely to be considered as being schematic and not true to scale.

DETAILED DESCRIPTION

It is to be noted that features and components of different embodiments which are identical or at least functionally identical to the corresponding features or components of the embodiment are provided with the same reference numbers or with different reference numbers which differ only in their last number from the reference number of a (functionally) corresponding feature or of a (functionally) corresponding component. In order to avoid unnecessary repetitions, features and components which have already been explained with reference to a previously described embodiment will no longer be explained in detail at a later point.

The embodiments which are described below merely represent a restricted selection of possible embodiment variants of the invention. In particular, it is possible to combine the features of individual embodiments with one another in a suitable way, with the result that the embodiment with variants which is illustrated explicitly here is to be considered by a person skilled in the art as disclosing a multiplicity of different embodiments in an obvious way.

Figure 1:
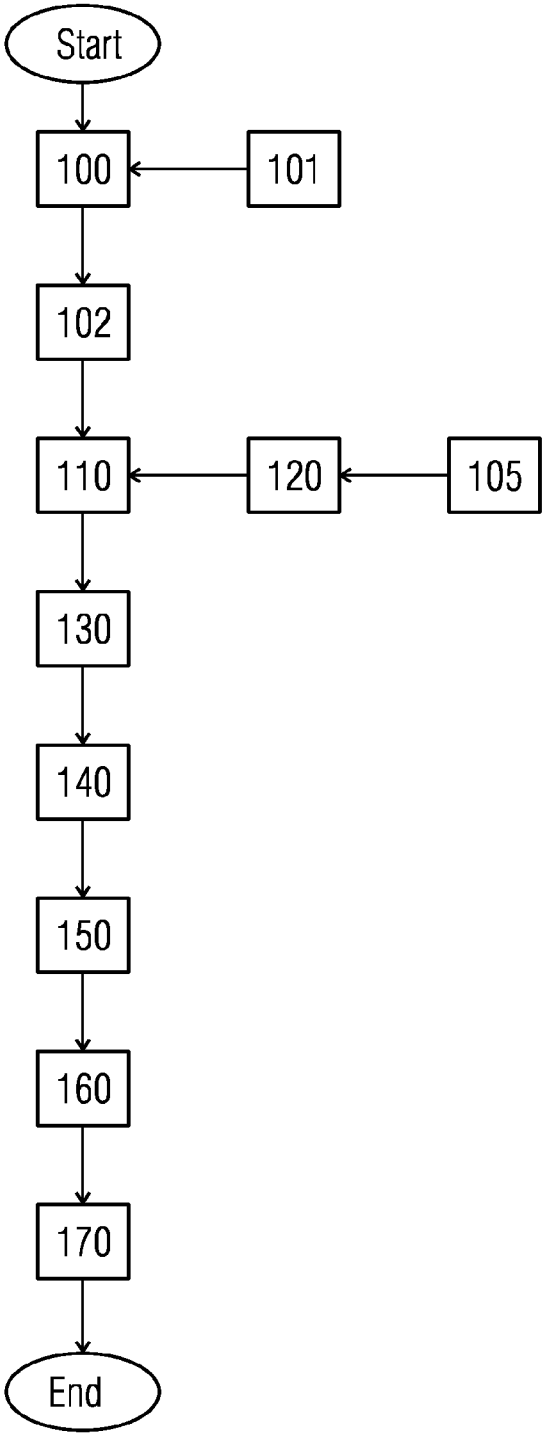
FIG. 1 shows a schematic illustration of a proposed method for balancing cylinders according to teachings of the present disclosure.

FIG. 1 shows a schematic illustration of a proposed method for balancing cylinders according to teachings of the present disclosure. In this context, FIG. 1 shows a method for balancing cylinders in a motor vehicle, wherein the motor vehicle has an engine which has at least two cylinders 120, and wherein the method comprises: determining a cycle period 100 of a cycle 100*a* of the engine and a number of cycles 100*a* of the engine, determining a cylinder value function 110 for each cylinder 120 of the engine for each cycle 100*a*, wherein the cylinder value function 110 is indicative of the acceleration of a crankshaft 200 of the engine, which is caused by the corresponding cylinder 120. In addition, the method comprises carrying out a signal analysis 130 for each determined cylinder value function 110, detecting an amplitude 140 for each signal analysis 130 which is carried out, forming an amplitude mean value 150 for each cylinder 120 on the basis of the detected amplitudes 140 of the respective cylinder 120, detecting irregular running 160 of the engine, on the basis of the amplitude mean values 150 which are formed, and compensating 170 the detected irregular running 160 of the engine.

Figure 2:
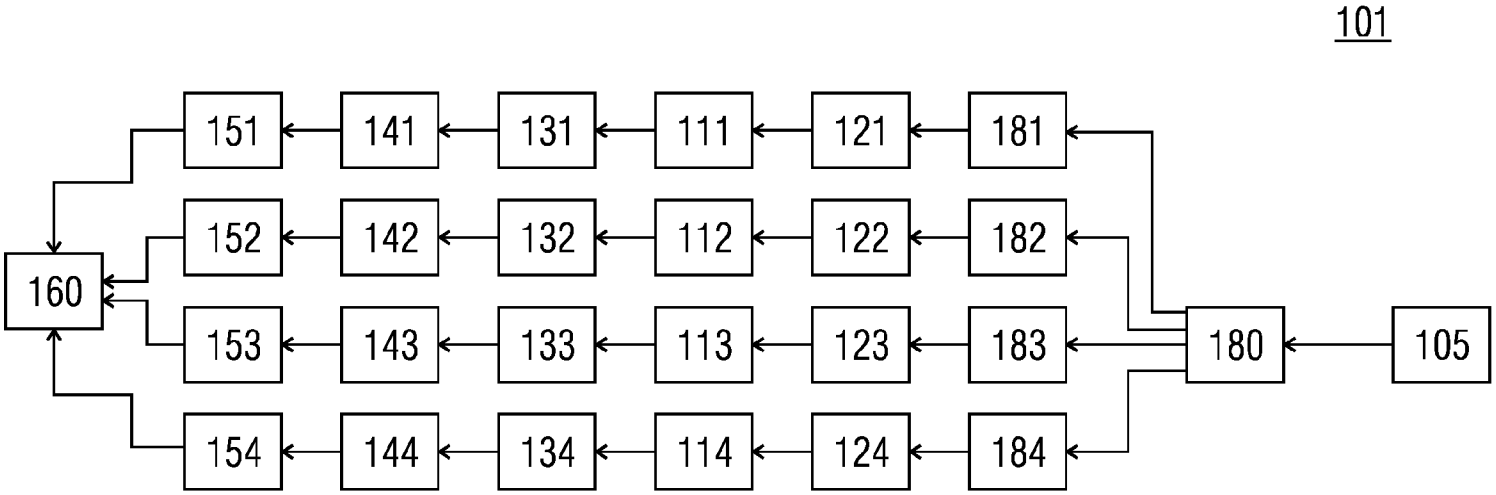
FIG. 2 shows a schematic illustration of an embodiment of the proposed method for balancing cylinders according to teachings of the present disclosure, FIG. 3-A shows an engine value function for a method for balancing cylinders according to teachings of the present disclosure, FIG. 3-B shows a cylinder value function of a cylinder for a method for balancing cylinders according to teachings of the present disclosure, FIG. 3-C shows a signal analysis of a cylinder value function of a cylinder for a first cycle for a method for balancing cylinders according to teachings of the present disclosure, FIG. 3-D shows a signal analysis of a cylinder value function of a cylinder for a second cycle for a method for balancing cylinders according to teachings of the present disclosure.
Figure 3A:
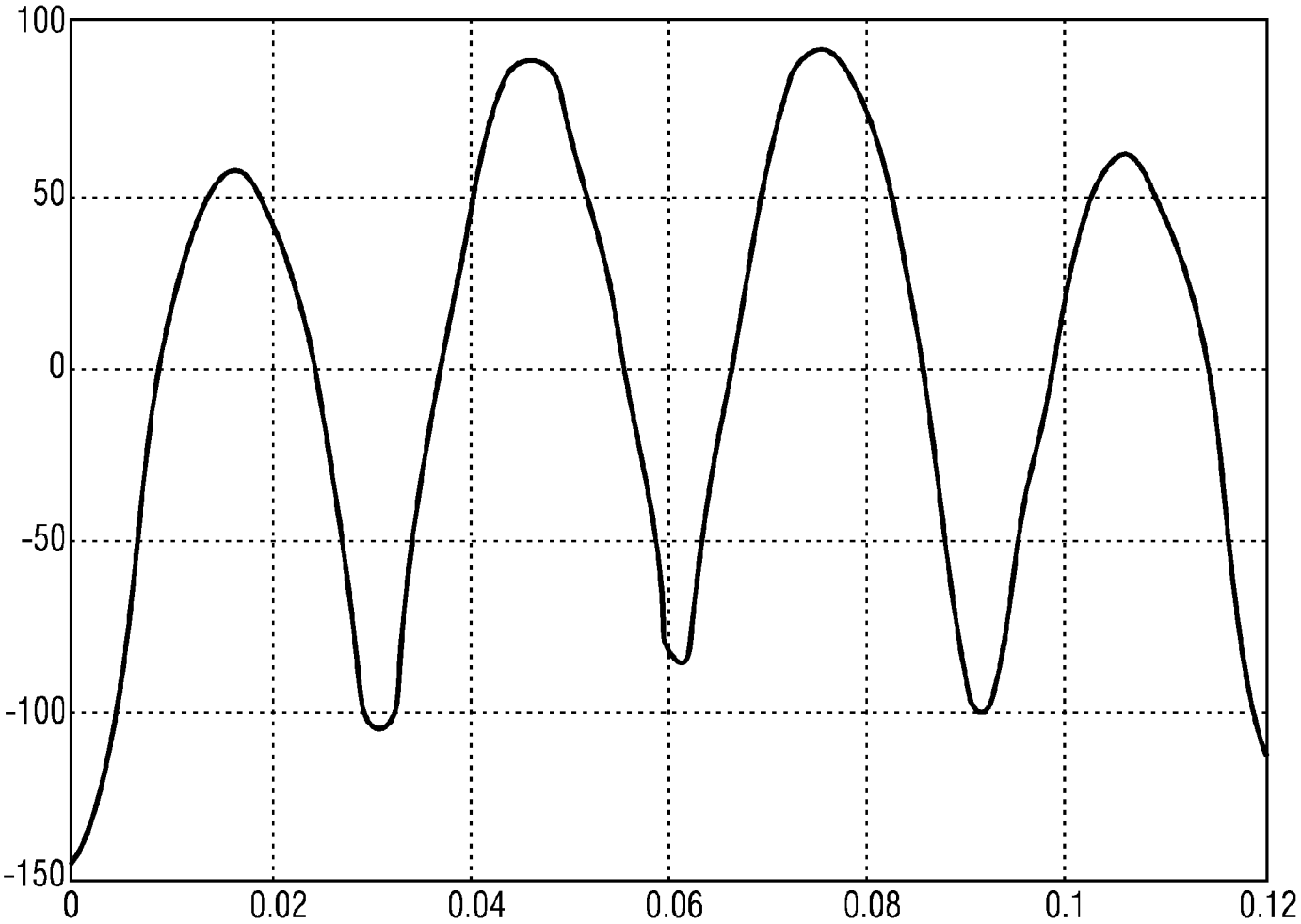
Figure 3B:
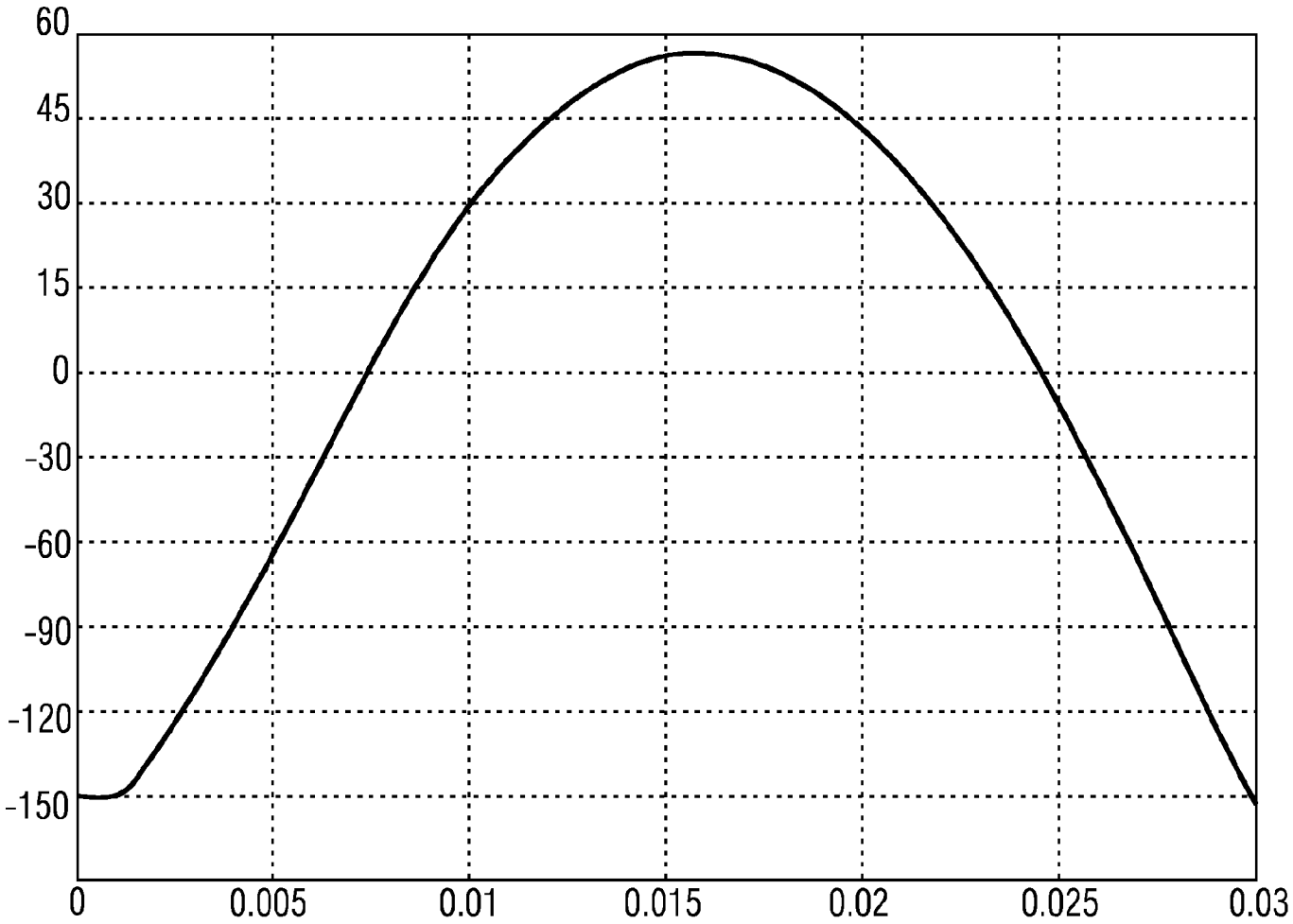
Figure 3C:
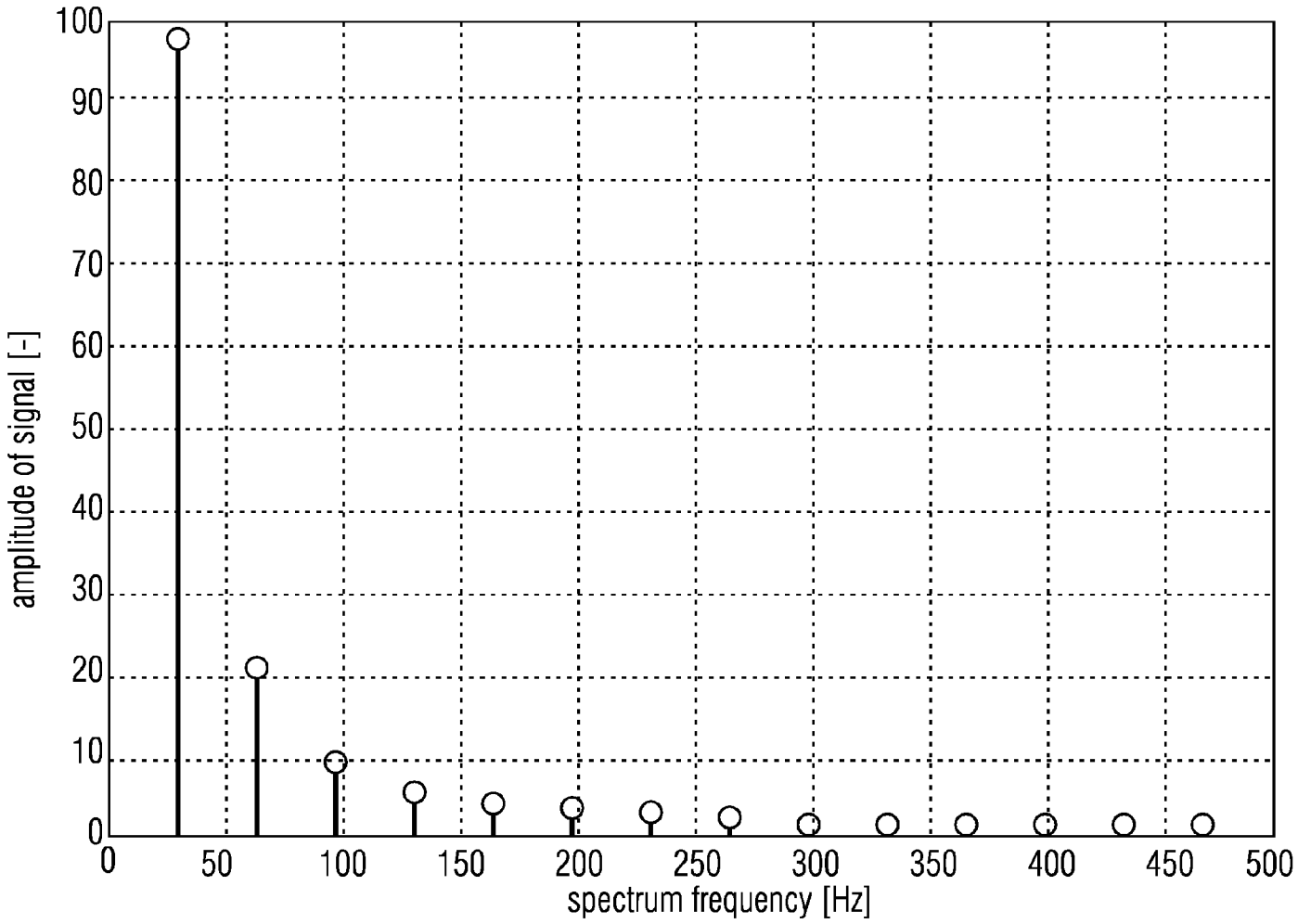
Figure 3D:
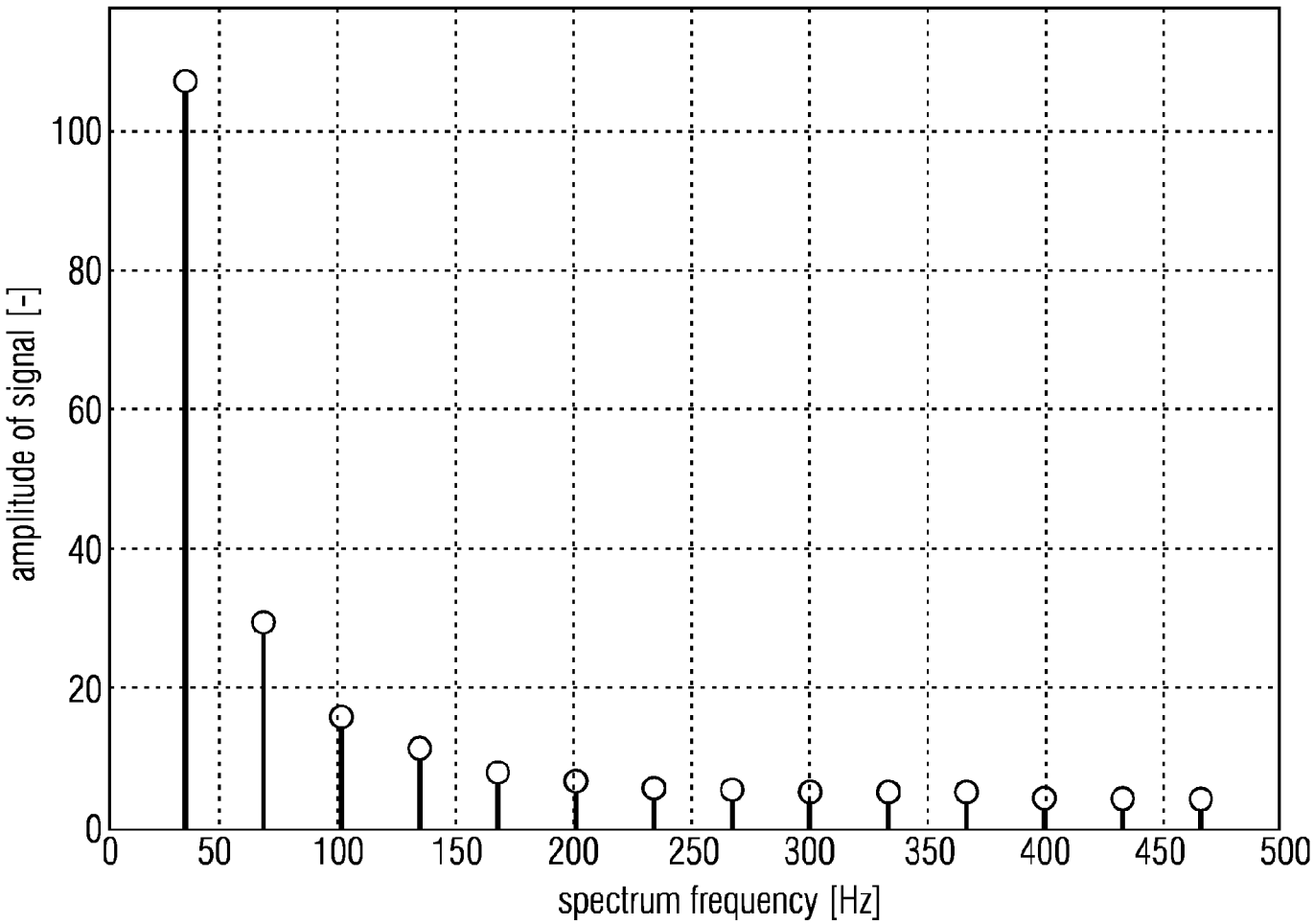

FIG. 2 shows a schematic illustration of an exemplary refinement of a proposed method for balancing cylinders according to teachings of the present disclosure. In this context, FIG. 2 shows part of a method for balancing cylinders according to FIG. 1, wherein the determination of the cylinder value function 111, 112, 113, 114 for each cylinder 121, 122, 123, 124 of the engine for each cycle 100*a* is carried out on the basis of an engine value function 180, wherein the engine value function 180 is indicative of the acceleration of a crankshaft 200 of the engine which is caused by all the cylinders 121, 122, 123, 124.

In addition, the determination of the cylinder value function 111, 112, 113, 114 for each cylinder 121, 122, 123, 124 of the engine for each cycle 100*a* is carried out on the basis of a corresponding subdivision 181, 182, 183, 184 of the engine value function 180. For each determined cylinder value function 111, 112, 113, 114, a signal analysis 131, 132, 133, 134 is carried out, and for each signal analysis 130, 131, 132, 133, 134 which is carried out an amplitude 141, 142, 143, 144 is detected. Then, an amplitude mean value 151, 152, 153, 154 is formed for each cylinder 121, 122, 123, 124 on the basis of the detected amplitudes 141, 142, 143, 144 of the respective cylinder 121, 122, 123, 124.

Figure 4:
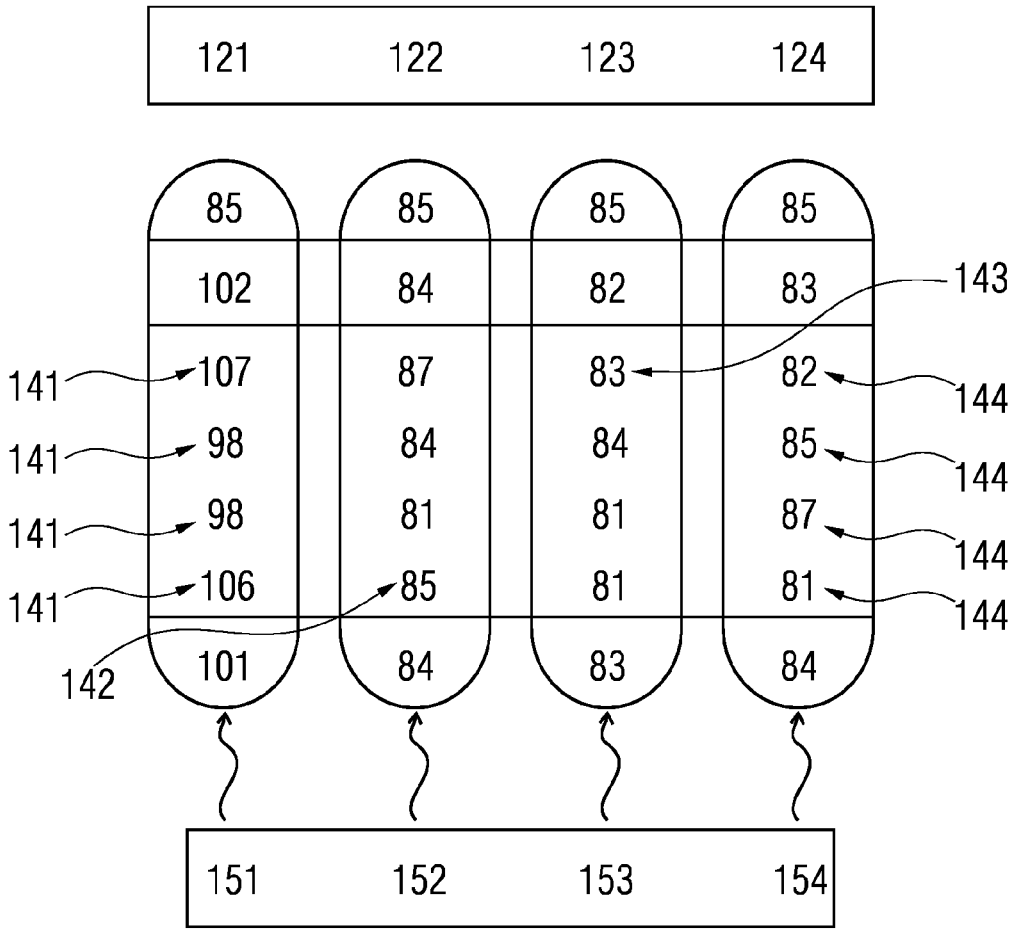
FIG. 4 shows an exemplary amplitude table for four cylinders of an engine for a method for balancing cylinders according to teachings of the present disclosure.

FIG. 3-A shows an engine value function for a method for balancing cylinders according to teachings of the present disclosure. FIG. 3-B shows a cylinder value function of a cylinder for a method for balancing cylinders according to teachings of the present disclosure. FIG. 3-C shows a signal analysis of a cylinder value function of a cylinder for a first cycle for a method for balancing cylinders according to teachings of the present disclosure, and FIG. 3-D shows a signal analysis of a cylinder value function of a cylinder for a second cycle for a method for balancing cylinders according to teachings of the present disclosure. In this context, FIG. 3 shows effects of a conventional tooth time analysis referred to a segment, when superimposition by means of a low-frequency interference occurs. In this context, Fast Fourier transformation signals are observed over a plurality of working cycles on a cylinder-specific basis. In this context, the low-frequency interference moves from one cylinder to the next as an asynchronous irregularity. In order to gate out this effect, as shown in FIG. 4, a cylinder-specific amplitude mean value 151, 152, 153, 154 is formed from a plurality of cycles 100*a*. The number of cycles 100*a* is determined at this example according to the expected interference frequency. In this case, no balancing function should be active. In this context, the squares of the absolute values of the spectral components of the synchronous signal/asynchronous interference are not added. The addition occurs vectorially. The differences between the mean values 151, 152, 153, 154 of the cylinders 121, 122, 123, 124 illustrated in FIG. 2 can then serve as a measure of the synchronous irregular running 160 of the engine which is illustrated in FIG. 1. This irregular running 160 can then be compensated 170, for example, by means of known cylinder balancing equations, for example by means of a closed-loop control system.

In the example in FIG. 3, in the case of a four-cylinder engine an injection mass which is increased by approximately 10% is added in the case of one cylinder, and with respect to the injection masses of the other three cylinders of the engine. In addition, low-frequency interference, such as can be caused, for example, by secondary assemblies of the motor vehicle, is superimposed.

Owing to the increased injection mass in one of the cylinders 121 and the low-frequency interference and increased torque profile which is caused by this, an excitation of the rotational speed of the engine can be observed in FIG. 3-A. FIG. 3-A shows here the engine value function 180 of the engine for the previously described example. FIG. 3-B shows here a cylinder value function 111 for the first cylinder 121 of the engine value function 180 from FIG. 3-A. The diagrams in FIGS. 3-C and 3-D show a frequency analysis as signal analysis 131 of the first cylinder 121 at a specific first time and then two cycles 100*a* later. In this context, the two cycles correspond to a 1440° crankshaft angle, also referred to as crank angle. The crankshaft angle/crank angle is also denoted in abbreviated form here by CRK. When a spectral analysis over 720° CRK is considered, it is not possible to separate out the two influences on the rotational speed. However, it is noticeable that in FIGS. 3-C and 3-D a predominant 33 Hz component is clearly apparent in each case. However, the signals cannot be divided into the component caused by the trimmed injection and into the component caused by the low-frequency secondary assembly interference, even over 1440° CRK. If, however, the amplitude 141 of the cylinder 121 is compared over several cycles 100*a*, it is noticeable in FIG. 4 that this amplitude 141 is no longer constant. Certain cyclical fluctuation is apparent. FIG. 4 shows an exemplary amplitude table for four cylinders of an engine for a method for balancing cylinders according to teachings of the present disclosure. In this context, FIG. 4 shows the amplitudes 141, 142, 143, 144 of the cylinders 1 to 4 of the engine. The first value line of the amplitude table shows here the amplitudes 141, 142, 143, 144 as ratios for cylinder-specific injection which is uniform and without interference. Each cylinder 121, 122, 123, 124 has here the same amplitude. If the first cylinder 121 is enriched by an injection mass which is increased by 10%, the amplitude 141 of the first cylinder 121 changes severely and those amplitudes 142, 143, 144 of the other three cylinders 122, 123, 124 merely change marginally, as is illustrated in the second value line. In this context, the amplitudes 141, 142, 143, 144 of the four cylinders 121, 122, 123, 124 do not change every 720° CRK. The irregular running 160 caused by the trimmed injection therefore constitutes synchronous interference.

However, if low-frequency interference is additionally superimposed, the amplitudes 141, 142, 143, 144 of the four cylinders 121, 122, 123, 124 are amplified, wherein the amplitude 140 of one cylinder 120 is no longer constant even every 720° CRK, as is apparent from the value lines three to six. The irregular running 160 which is caused by the secondary assemblies therefore constitutes asynchronous interference. Separation of the above-mentioned signals is therefore not possible. However, if the amplitudes of each individual cylinder 121, 122, 123, 124 are averaged over a plurality of working cycles, as illustrated in the value line seven, the original irregularity which is caused by the trimmed injection in the first cylinder 121 can be reconstructed from the value line two again and correspondingly closed-loop controlled by a suitable algorithm. It was therefore possible to eliminate the asynchronous interference.

To summarize, it is to be noted that according to teachings of the present disclosure it is possible to separate the rotational speed irregularities generated by secondary assemblies from those rotational speed irregularities which are caused by a trimmed injection. Balancing of cylinders can therefore be performed more accurately.

LIST OF REFERENCE NUMBERS

100 Cycle period
100*a* Cycle
100*b* Cycle time period
110 Cylinder value function of a cylinder
111 Cylinder value function of a first cylinder
112 Cylinder value function of a second cylinder
113 Cylinder value function of a third cylinder
114 Cylinder value function of a fourth cylinder
120 Cylinder
121 First cylinder
122 Second cylinder
123 Third cylinder
124 Fourth cylinder
130 Signal analysis for a cylinder
131 Signal analysis for a first cylinder
132 Signal analysis for a second cylinder
133 Signal analysis for a third cylinder
134 Signal analysis for a fourth cylinder
140 Amplitude of a signal analysis for a cylinder
141 Amplitude of a signal analysis for a first cylinder
142 Amplitude of a signal analysis for a second cylinder
143 Amplitude of a signal analysis for a third cylinder
144 Amplitude of a signal analysis for a fourth cylinder
150 Amplitude mean value of amplitudes for a cylinder
151 Amplitude mean value of amplitudes for a first cylinder
152 Amplitude mean value of amplitudes for a second cylinder
153 Amplitude mean value of amplitudes for a third cylinder
154 Amplitude mean value of amplitudes for a fourth cylinder
160 Irregular running of the engine
170 Compensation of irregular running of the engine
180 Engine value function
181 Subdivision of an engine value function for a corresponding first cylinder
182 Subdivision of an engine value function for a corresponding second cylinder
183 Subdivision of an engine value function for a corresponding third cylinder
184 Subdivision of an engine value function for a corresponding fourth cylinder
200 Acceleration of a crankshaft of an engine

What is claimed is:

1. A method for balancing cylinders in a motor vehicle including an engine which has at least two cylinders, the method comprising:

determining a cycle period of a cycle of the engine and a number of cycles of the engine, determining a cylinder value function for each cylinder of the engine for each cycle over the number of cycles, wherein the cylinder value function represents acceleration of a crankshaft of the engine caused by the corresponding cylinder, carrying out a signal analysis for each determined cylinder value function, detecting an amplitude for each signal analysis, forming an amplitude mean value for each cylinder on the basis of the detected amplitudes of the respective cylinder, detecting an interference with regular running of the engine, on the basis of the amplitude mean values which are formed, and identifying a synchronous component of the interference as irregular running caused by an injection amount and an asynchronous component of the interference as a secondary assembly interference, compensating for the detected irregular running of the engine by adjusting the injection amount.

2. The method for balancing cylinders as claimed in claim 1, wherein the determination of the cylinder value function for each cylinder of the engine for each cycle is carried out on the basis of an engine value function, wherein the engine value function is indicative of the acceleration of a crankshaft of the engine which is caused by all the cylinders.

3. The method for balancing cylinders as claimed in claim 2, wherein the engine value function is formed on the basis of the detection of values relating to an engine variable of the engine over a cycle time period.

4. The method for balancing cylinders as claimed in claim 3, wherein the cycle time period corresponds to a total duration of the number of cycles.

5. The method for balancing cylinders as claimed in claim 2, wherein the determination of the cylinder value function for each cylinder of the engine for each cycle is carried out on the basis of a corresponding subdivision of the engine value function.

6. The method for balancing cylinders as claimed in claim 1, wherein the signal analysis has a frequency analysis, preferably the spectral analysis of a Fourier transformation, preferably a Fast Fourier transformation.

7. The method for balancing cylinders as claimed in claim 1, wherein the cycle period is that time period which corresponds to a working cycle of the engine.

8. The method for balancing cylinders as claimed in claim 1, wherein the determination of the number of cycles is carried out on the basis of a prediction.

9. The method for balancing cylinders as claimed in claim 1, wherein the compensation of the detected irregular running of the engine is carried out on the basis of an algorithm, preferably on the basis of a cylinder balancing algorithm, particularly preferably on the basis of a cylinder balancing via engine roughness algorithm and/or a closed loop combustion control algorithm.

10. An internal combustion engine, comprising:

at least two cylinders driving a crankshaft, one rotation of the crankshaft defining a cycle of the engine;

a controller programmed to:

determine a cycle period of the cycle of the engine and a number of cycles of the engine, determine a cylinder value function for each cylinder of the engine for each cycle over the number of cycles, wherein the cylinder value function represents acceleration of the crankshaft caused by the corresponding cylinder, carry out a signal analysis for each determined cylinder value function, detect an amplitude for each signal analysis, form an amplitude mean value for each cylinder on the basis of the detected amplitudes of the respective cylinder, detect an interference with regular running of the engine, on the basis of the amplitude mean values which are formed, and identify a synchronous component of the interference as irregular running caused by an injection amount and an asynchronous component of the interference as a secondary assembly interference, compensate for the detected irregular running of the engine by adjusting the injection amount.

11. An internal combustion engine as claimed in claim 10, wherein the determination of the cylinder value function for each cylinder of the engine for each cycle is carried out on the basis of an engine value function, wherein the engine value function is indicative of the acceleration of a crankshaft of the engine which is caused by all the cylinders.

12. An internal combustion engine as claimed in claim 11, wherein the engine value function is formed on the basis of the detection of values relating to an engine variable of the engine over a cycle time period.

13. An internal combustion engine as claimed in claim 10, wherein the cycle time period corresponds to a total duration of the number of cycles.

14. An internal combustion engine as claimed in claim 11, wherein the determination of the cylinder value function for each cylinder of the engine for each cycle is carried out on the basis of a corresponding subdivision of the engine value function.

15. An internal combustion engine as claimed in claim 10, wherein the signal analysis has a frequency analysis, preferably the spectral analysis of a Fourier transformation, preferably a Fast Fourier transformation.

16. An internal combustion engine as claimed in claim 10, wherein the cycle period is that time period which corresponds to a working cycle of the engine.

17. An internal combustion engine as claimed in claim 10, wherein the determination of the number of cycles is carried out on the basis of a prediction.

18. An internal combustion engine as claimed in claim 10, wherein the compensation of the detected irregular running of the engine is carried out on the basis of an algorithm, on the basis of a cylinder balancing algorithm, or on the basis of a cylinder balancing via engine roughness algorithm and/or a closed loop combustion control algorithm.

* * * * *